US012365500B2

(12) United States Patent
Canalicchio et al.

(10) Patent No.: US 12,365,500 B2
(45) Date of Patent: Jul. 22, 2025

(54) PACKAGING METHOD FOR PACKAGING PRIMARY PACKAGES INTO SECONDARY PACKAGES AND PACKAGING MODULE

(71) Applicant: Krones Aktiengesellschaft, Neutraubling (DE)

(72) Inventors: Christian Canalicchio, Bad Endorf (DE); Simon Vockensperger, Rosenheim (DE); Thomas Stadler, Kolbermoor (DE); Christian Westermeier, Oberaudorf (DE)

(73) Assignee: Krones Aktiengesellschaft, Neutraubling (DE)

( * ) Notice: Subject to any disclaimer, the term of this patent is extended or adjusted under 35 U.S.C. 154(b) by 0 days.

(21) Appl. No.: 17/729,293

(22) Filed: Apr. 26, 2022

(65) Prior Publication Data

US 2022/0348367 A1 Nov. 3, 2022

(30) Foreign Application Priority Data

Apr. 28, 2021 (DE) ..... 10 2021 110 894.2

(51) Int. Cl.
*B65B 21/18* (2006.01)
*B65B 5/02* (2006.01)
(Continued)

(52) U.S. Cl.
CPC ..... *B65B 21/18* (2013.01); *B65B 5/024* (2013.01); *B65B 27/04* (2013.01); *B65B 35/36* (2013.01)

(58) Field of Classification Search
None
See application file for complete search history.

(56) References Cited

U.S. PATENT DOCUMENTS 2,753,673 A * 7/1956 Olive ..... B65B 39/006 53/247
3,302,370 A * 2/1967 Van Luxemborg ..... B65B 21/18 53/539

(Continued)

FOREIGN PATENT DOCUMENTS

DE 1238378 B * 4/1967 ..... B65B 11/004
WO WO-2014125627 A1 * 8/2014 ..... B25J 15/0066

OTHER PUBLICATIONS

German Application DE 10 2021 110 894.2—Filed Apr. 28, 2021—German Search Report dated Dec. 23, 2021.
Extended European Search Report dated Sep. 8, 2022.

*Primary Examiner* — Tanzim Imam
(74) *Attorney, Agent, or Firm* — Simmons Perrine Moyer Bergman PLC

(57) ABSTRACT

A packaging method is described in which at least one primary packaging (2) is inserted through a closable opening into a secondary packaging (3) after a handling device (20) has been positioned at the closable opening of the secondary packaging (3). The primary packaging (2) is guided by the handling device (20) during its insertion into the opening of the secondary packaging (3), and a target position of the primary packaging (2) is predetermined within the secondary packaging (3). After insertion of the at least one primary packaging (2) into the secondary packaging (3), the opening of the secondary packaging (3) is at least partially closed under the cooperation or action of the handling device (20). Furthermore, a packaging module is described which is designed to perform such a packaging process.

18 Claims, 5 Drawing Sheets

(51) Int. Cl.
*B65B 27/04* (2006.01)
*B65B 35/36* (2006.01)

(56) References Cited

U.S. PATENT DOCUMENTS

| | | | | | |
|---|---|---|---|---|---|
| 3,335,542 | A * | 8/1967 | Van Luxemborg | B65B 21/18 | 53/247 |
| 3,481,108 | A * | 12/1969 | Justis | B65B 39/006 | 53/244 |
| 4,171,603 | A * | 10/1979 | Wiseman | B65B 39/006 | 53/248 |
| 4,316,762 | A * | 2/1982 | Martin | B65C 3/14 | 156/215 |
| 4,439,974 | A * | 4/1984 | Wiseman | B65B 39/006 | 53/248 |
| 9,493,260 | B2 * | 11/2016 | Koch | B65B 21/24 | |
| 10,322,833 | B2 * | 6/2019 | Hutter | B65B 21/20 | |
| 2004/0003574 | A1 * | 1/2004 | Hartness | B65B 21/183 | 53/247 |
| 2016/0332758 | A1 * | 11/2016 | Grappoli | B65B 21/18 | |
| 2016/0347488 | A1 * | 12/2016 | Ford | B65B 43/50 | |
| 2017/0043890 | A1 * | 2/2017 | Barkerding | B65B 39/006 | |
| 2019/0185190 | A1 * | 6/2019 | Fechter | B65B 43/42 | |
| 2020/0189776 | A1 * | 6/2020 | Stadler | B65B 43/52 | |

* cited by examiner

PACKAGING METHOD FOR PACKAGING PRIMARY PACKAGES INTO SECONDARY PACKAGES AND PACKAGING MODULE

CLAIM OF PRIORITY

The present application claims priority to German Application DE 10 2021 110 894.2 filed Apr. 28, 2021, which is incorporated by reference.

FIELD OF THE INVENTION

The present invention relates to a packaging method for packaging primary packagings into secondary packagings having the features of the independent method claim. In addition, the invention relates to a packaging module of a packaging device having the features of the independent device claim.

BACKGROUND OF THE INVENTION

In many packaging processes it is necessary to carry out several successive packaging steps in sequential order so that the individual packaging steps do not influence or interfere with each other. A common procedure, for example, is to first group a defined number of individual packaging goods and then insert them together as a grouped arrangement into an outer packaging.

Since such outer packagings are often formed by folding carton packagings, care must first be taken during insertion of the article group to ensure that it is correctly inserted into the outer packaging. To ensure this, mechanical insertion aids are often used, which insertion aids are, for example, formed as insertion frames. This refers to template-like guides that can have a funnel-shaped circumferential edge, which effectively prevents incorrect insertion of the respective article group into the outer packaging.

If the outer packaging is an open folding carton, the insertion frame can also be assigned the task of preventing the open folding flaps from folding over or the task of positioning the folding flaps at an angle to facilitate the insertion of the article group. Once the article group has been inserted into the outer packaging, the insertion frame can be removed in order to subsequently fold the folding flaps over the opening, thereby using a further special tool and thus closing the folding carton. If necessary, additional closing aids can be used, which can, for example, ensure that the folding flaps closed over the opening of the folding carton are glued or clamped together.

The sequential use of several different handling tools for successive but mutually isolated procedural steps for the insertion and packaging of articles into outer packagings and in the subsequent closing of the outer packagings slows down the packaging method on the one hand, but on the other hand it also increases the control and monitoring effort, because the successive procedural steps can hardly be integrated, but rather care must be taken that the handling tools do not interlock or interfere with each other. Last but not least, the procedural steps that have to be coordinated require more space within the packaging machine, since several handling modules have to be accommodated, each of which handling module is specialized for its intended use and equipped accordingly.

In view of the recognized disadvantages of such machine configurations, it may be considered a primary objective of the invention to integrate several of these procedural steps and to provide a handling module that should be capable of performing several of the aforementioned tasks simultaneously or in close temporal succession, which tasks are to be performed when inserting an article grouping into an outer packaging and subsequently closing the outer packaging.

This objective is achieved by the objects of the independent claims. Features of advantageous further embodiments of the invention result from the dependent claims.

SUMMARY OF THE INVENTION

To achieve the above objective, the invention proposes a method for packaging primary packagings into secondary packagings and/or for merging primary packagings with secondary packagings enveloping the primary packagings. In this packaging method, at least one primary packaging is inserted through a closable opening into a provided secondary packaging with the assistance of a handling device. Earlier, a handling device was positioned at the closable opening of the secondary packaging, which handling device guides and/or directs the at least one primary packaging during its insertion into the opening of the provided secondary packaging and which handling device specifies a target position of the at least one primary packaging within the secondary packaging.

After insertion of the at least one primary packaging into the secondary packaging, the opening of the secondary packaging is at least partially closed under the cooperation or action of the handling device. The handling device used in the packaging method according to the invention thus functions on the one hand as a positioning aid, which positioning aid ensures that the primary packaging or the plurality of grouped primary packagings can be brought into their intended target positions within the secondary packaging without interference.

On the other hand, in addition to its positioning support or positioning aid, the handling device fulfills a dual function in that, after the primary packaging or the plurality of primary packagings have been inserted into the secondary packaging, it acts on the secondary packaging in such a way that the opening of the secondary packaging is closed or at least partially closed.

Since these two core functions performed with the handling device are related in time and space, but by their nature are not performed simultaneously, it may be useful to first terminate the function of the positioning aid before starting to close the secondary packaging.

If, for example, the positioning aid is formed by a centering frame or similar device, it may be useful in individual cases to first distance the positioning aid from the secondary packaging before the closing function of the handling device is activated, which provides for closing or partial closing of the secondary packaging. Especially it may be useful to lift the positioning aid off the secondary packaging or to at least slightly distance it from the secondary packaging.

Since the secondary packaging to be handled in each instance forms the reference point for the procedural steps of the packaging method according to the invention considered here, the insertion of the at least one primary packaging into the secondary packaging and the operation of closing or partially closing the opening of the secondary packaging also take place in each instance at the same location, namely the current location of the secondary packaging formed, for example, by an outer packaging of cardboard or of another suitable packaging material. Of course, this does not exclude the possibility that this reference location may move, since the whereabouts of the secondary packaging may also change constantly, which may be the case, for example, with a secondary packaging continuously being transported on a horizontal conveyor or the like.

A manipulation device or gripping device responsible for gripping, handling and inserting the primary packaging or the plurality of primary packagings can preferably be moved synchronously in the same direction with a moving secondary packaging, which can also be regarded as a synchronization. In such a case, a conveying device, the secondary packaging transported on the latter, the handling device acting as a positioning aid, and the manipulation device or gripping device together with the primary packaging or primary packagings held thereon all move at the same speed in the same direction of movement, which in turn satisfies the requirement for the reference location to be stationary during insertion and closing.

Optionally, however, the secondary packaging can also be standing still during the procedural steps described.

It can thus be stated as a feature of the method, which is equally applicable to all variations explained here and which is recognizable across the board, that in the packaging method according to the invention, both a temporal and a local component of the insertion of the at least one primary packaging into the secondary packaging and the closing of the secondary packaging are closely related to one another or are coupled with one another, because the insertion of the primary packagings into the secondary packaging and the subsequent closing of the secondary packagings take place at the same place, even if this has to take place sequentially in terms of time.

During the insertion of the at least one primary packaging into the secondary packaging, the opening of the secondary packaging must still be accessible. During the closing of the opening of the secondary packaging, the at least one primary packaging or the plurality of primary packagings must already be at its destination inside the secondary packaging. Thus, both processes take place at the same location, but are performed temporally consecutive one after the other.

A further variation of the method provides that the handling device is equipped with movable and controllable closing elements, which closing elements at least partially close the secondary packaging at its opening after the at least one primary packaging has been inserted therein.

The closable opening of the secondary packaging can, for example, be designed in such a way that the secondary packaging has at least one folding flap on at least one lateral edge of its opening, which folding flap can be placed on the opening by folding over and which folding flap can at least partially close the opening. Such closing mechanisms are known from numerous packaging variants and are commonly used in this context, for example in cardboard packaging of all kinds. However, since the lateral folding flaps can often assume undefined positions and, in particular, are freely movable, it can be useful to guide them or hold them in place during the insertion of the primary packagings into the secondary packaging and to subsequently grasp them and fold them over by suitable tools in order to close the opening in this way.

In addition, the controllable closing elements of the handling device can be used to apply or affix further suitable closures, such as adhesive points, glue dots, staples, etc. Thus, in addition to the insertion frame and the closing elements, the handling device acting as a positioning aid can have additional components, e.g. for applying adhesive, for clamping the folding flaps or the like, which additional components can be usefully activated after the use of the closing elements or which additional components may also be used immediately beforehand if, for example, adhesive dots are involved, which adhesive dots are applied to the inside of the folding flaps before they are folded over.

The closing elements designated as such here can, for example, comprise lever mechanisms that can be controlled and actuated electrically, pneumatically or hydraulically. Accordingly, pivoting levers controlled in this way can ensure an exact closing movement of the folding flaps of the folding carton forming the secondary packaging, which folding flaps at first do not cover the opening. If necessary, additional gripping clamps or gripping tongs or the like can be arranged on these pivoting levers, which can be suitable for gripping the folding flaps and grasping them during their pivoting.

However, since the positions and movement ranges of the folding flaps are normally known and limited, it should usually be sufficient in practice to design the closing elements by pivoting levers with a clearly defined movement profile, since in this way more complex actuating movements and control mechanisms can be dispensed with, without this having to be associated with disadvantages in the task performance of the handling device.

Optionally, the above-mentioned handling device, which functions here among others as a positioning aid, may comprise an insertion frame, which insertion frame is placed on or brought into exact alignment with the peripheral edge of the opening at least during the insertion of the at least one primary packaging into the secondary packaging. For this reason, it is absolutely useful that such an insertion frame is dimensioned and shaped to correspond to the size and contour of the edge of the opening of the secondary packaging, so that it can fulfill its task optimally and reliably prevent incorrect insertion into the secondary packaging.

It may be provided, for example, that the insertion frame comprises a compartment corresponding to the number and grouping of the primary packagings. By the support of such a compartment, the primary packagings can be advantageously moved or guided therethrough during the insertion into the secondary packaging. Thus, it can be achieved, that the compartment defines the target positions of the primary packagings within the secondary packaging. The at least one primary packaging or the articles forming the primary packagings designated as such herein can thus be grasped by a suitable manipulation device and guided through the insertion frame and inserted into the secondary packaging.

In the method, it is preferably provided, that the manipulation device is brought in particular into exact alignment with the insertion frame and is moved using the insertion frame as a reference. It is also preferably provided, that the insertion frame, which can also be called centering frame, is pulled or moved out of the secondary packaging again before the secondary packaging is closed.

The method may optionally provide, that the handling device is at least slightly distanced from the secondary packaging during closure thereof and that the handling device is removed from the secondary packaging after closure has been completed.

A further useful option in the method according to the invention can be, that the manipulation device is formed by a gripper head with bottle grippers, gripping tulips or the like. In this case, the individual grippers can be designed as so-called gripping tulips, which are activated with sufficiently strong negative pressure and are designed for gripping individual bottles or containers in their neck area. By arranging several such gripping tulips within one gripper head, larger groups of regularly arranged bottles or containers can be gripped and moved at the same time, for example, in order to remove them from a conveying belt and to insert them into the secondary packaging, which secondary packaging is formed, for example, by a folding carton.

This folding carton can then be closed by the closing elements located on the handling device, after the insertion frame of the handling device has previously ensured that the article grouping or container grouping seized by the gripper head is inserted exactly into its target position within the folding carton, without any collisions of individual bottles or containers with the surrounding edge of the carton.

The description of the various method variations makes it clear that the primary packagings are sensibly inserted in a perpendicular or approximately perpendicular direction to the surface of the opening of the secondary packaging, whereby this surface can be described, for example, as spanning a plane perpendicular to the direction of insertion. If the primary packagings are inserted at an angle, the insertion frame provided by the handling device could perform its task significantly worse than if the primary packagings are inserted into the secondary packaging exactly vertically or in minimal deviation from a vertical direction of movement.

The skilled technical person as reader will recognize that he can combine almost all of the method variations explained above in a meaningful way. However, if such a combination does not make sense in an individual case or does not appear to the skilled person to make sense, he will not carry it out with reversion to his expert knowledge.

It should be emphasized at this point, that the items referred to here as primary packagings can be formed by articles of all kinds, by packaging goods such as containers, cartons, bottles, beverage cans etc., which can be inserted into outer packagings. For this reason, the outer packagings referred to herein as secondary packagings are formed in particular by folding cartons equipped with closable openings for receiving the packaging goods and which folding cartons are equipped, for example, with folding flaps, which folding flaps can be folded down and which folding flaps allow these openings to be closed after the packaging goods have been properly inserted.

In order to achieve at least some of the above-mentioned objectives, the present invention proposes, in addition to the packaging method explained in various variants, a packaging module of a packaging device having the features of the independent device claim. The packaging module is for repackaging primary packagings by inserting at least one primary packaging into a respective provided secondary packaging for this purpose. The packaging module comprises a manipulation device for grasping and inserting in each instance at least one primary packaging into a provided secondary packaging, as well as a handling device, which handling device can be attached to a closable opening of the provided secondary packaging in each instance and can be positioned there and which handling device also functions as a positioning aid, but which handling device in addition fulfills further tasks.

This handling device, which serves among other things as a positioning aid, can interact with the manipulation device in such a way that the at least one primary packaging can be guided and/or directed during its insertion into the opening of the provided secondary packaging and in that a target position of the at least one primary packaging within the secondary packaging can be predefined by the arrangement and orientation of the handling device.

The aforementioned further tasks comprise at least closing the secondary packaging after insertion of the at least one primary packaging, which is why the handling device is equipped with movable and controllable closing elements, which closing elements interact with sections of the secondary packaging in such a way that the closing elements can at least partially close the opening of the secondary packaging after insertion of the primary packaging.

For example, the handling device associated with the packaging module can be equipped with movable and controllable closing elements that at least partially close the secondary packaging at its opening.

According to a preferred embodiment of the packaging module according to the invention, the closing elements may be equipped with or comprise controllable levers and/or gripping elements, which levers and/or gripping elements can interact with folding flaps of the secondary packaging and fold the latter over the closable opening. The controllable levers can preferably be rotated or pivoted about pivot axes, which pivot axes are anchored to the handling device, so as to interact with the sections of the secondary packaging to be folded. In this way the secondary packaging, which secondary packaging is comprising the primary packaging or plurality of primary packagings within, can be closed by folding the foldable sections over the opening of the secondary packaging.

In particular, the secondary packaging can have at least one folding flap on at least one lateral edge of its opening, which folding flap can be placed on the opening by folding it over and which folding flap can at least partially close the opening. The aforementioned closing elements or pivoting levers can act on the at least one folding flap in order to close the secondary packaging in this way.

Optionally, the closing elements can be equipped with additional functions so that, for example, further closures can be used, actuated or activated with them. For example, it may be useful to apply adhesive with the closing elements or with additional actuators or applicators in order to adhere the folding flap to an underlying section of the secondary packaging or to clamp the folding flap to a section of the secondary packaging.

Sensibly, the handling device in its function as a positioning aid comprises an insertion frame, which insertion frame can be placed on or brought into exact alignment with the peripheral edge of the opening at least during insertion of the at least one primary packaging into the secondary packaging.

In this context, it is necessary to dimension the insertion frame corresponding to the size and contour of the edge of the opening of the secondary packaging, so that different sizes or contours of the secondary packaging, which secondary packaging may be processed by the packaging machine under consideration here, especially the packaging module, each require different handling devices or devices which can be optionally adapted thereto, with correspondingly shaped and dimensioned insertion frames.

When the primary packagings are inserted into the secondary packaging, the articles that form the primary packagings are detected by the manipulation device and guided through the insertion frame, which on the one hand can avoid the risk of collision or depositing at the opening edge of the secondary packaging. In addition, it can be ensured in this way that the primary packagings are guided precisely to their respective target position within the secondary packaging, where they can be deposited and inserted with a perfect fit.

This insertion process simultaneously ensures that the manipulation device can especially be brought into exact alignment with the insertion frame of the handling device and is moved using the insertion frame as a positioning reference.

The manipulation device so designated here can be formed, for example, by a movable and controllable gripper head with bottle grippers, gripping tulips or the like, with which prepared and suitably assembled groupings of articles such as containers, bottles, etc. can be seized and positioned. In particular, such a gripper head makes it possible to insert the articles or primary packagings seized thereby in a direction perpendicular to the surface of the opening, the insertion direction being a direction perpendicular to a plane spanned by the opening of the secondary packaging.

It should be expressly mentioned at this point that all aspects and embodiments explained in connection with the packaging method according to the invention can equally relate to or form partial aspects of the packaging module according to the invention, whereby the packaging module described above in various embodiments is or can in particular be a component of a packaging device. Therefore, if at any point in the description or also in the claim definitions relating to the packaging method according to the invention reference is made to specific aspects and/or interrelationships and/or effects, this applies equally to the packaging module according to the invention and/or to the packaging device equipped with such a packaging module, insofar as such a transfer is technically meaningful.

The same applies in reverse, so that all aspects and embodiments which have been explained in connection with the packaging module according to the invention equally concern or can be partial aspects of the packaging method according to the invention. Therefore, if at any point in the description or also in the claim definitions relating to the packaging module according to the invention reference is made to certain aspects and/or contexts and/or effects, this applies equally to the packaging method according to the invention.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged to facilitate an understanding of the invention.

Figure 2:
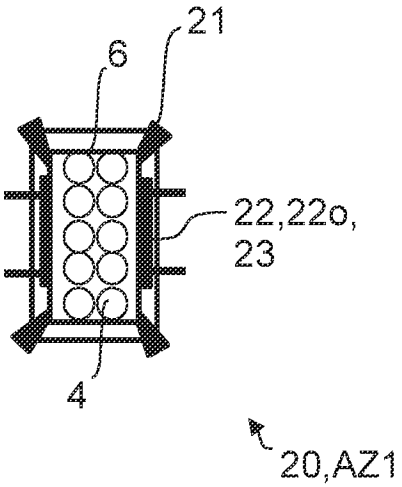
FIG. 2 shows a schematic view of a design of a handling device of the packaging module in a first working state.

The same or equivalent elements of the invention are designated by identical reference characters. Furthermore, and for the sake of clarity, only the reference characters relevant for describing the respective figure are provided. It should be understood, that the embodiments described are only examples describing an embodiment of the device according to the invention or the method according to the invention. They are not intended to limit the scope of the disclosure.

DETAILED DESCRIPTION OF THE INVENTION

Figure 1:
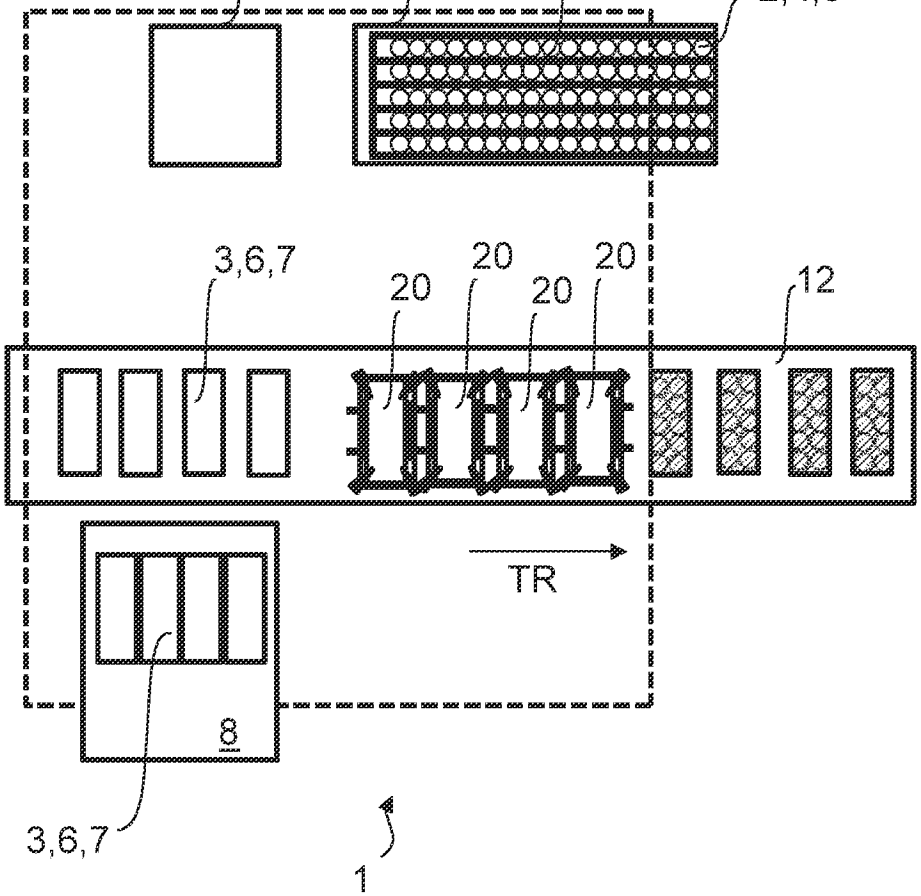
FIG. 1 shows an embodiment of a packaging module according to the invention.

The schematic top view of FIG. 1 shows an embodiment of a packaging module 1 according to the invention, which can in particular be a component of a packaging device or packaging system (not shown).

Figure 3:
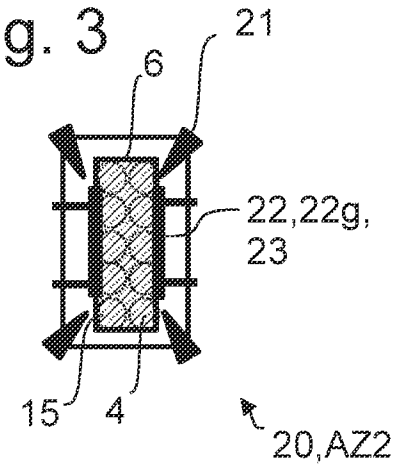
FIG. 3 shows a schematic view of a design of the handling device of the packaging module in a second working state.

FIGS. 2 and 3 each show a schematic configuration of a handling device 20 of the packaging module 1 in different working states AZ1, AZ2.

In addition to the schematically shown packaging module 1, the so designated packaging device or packaging system which is not shown in detail here, may further comprise suitable modules for forming primary packagings 2 and/or for assembling a plurality of secondary packagings 3 that are filled with primary packagings 2 (not shown), for example a blow molding module for producing plastic bottles, a filling and capping module, a labeling module and a palletizing module. In addition, other components can be integrated in a useful manner, which other components are known from filling and packaging methods and are commonly used there.

In the present context, primary packagings 2 refer to articles 4 of all kinds, for example beverage containers 5. Preferably, several beverage containers 5 are in each instance assembled and packaged within a secondary packaging 3 within the packaging module 1.

The articles 4 or beverage containers 5 are fed into the packaging module 1 via a suitable transport device 9. For example, such an infeed can take place in a feeding direction ZF in an ordered mass flow via a conveying belt 10, in which articles 4 transported in parallel are separated from each other by lane plates 11.

The secondary packagings 3 are formed, in particular, by outer packagings 6 in the form of folding cartons 7, which folding cartons 7 are provided, for example, in a magazine 8. The folding cartons 7 are, in particular, provided with closable openings for receiving the articles 4 and, for example, with folding flaps 15, which folding flaps 15 can be folded over and which folding flaps 15 allow these openings to be closed after the articles 4 have been properly inserted.

The packaging module 1 shown here is prepared, provided and equipped for carrying out a method in which at least one primary packaging 2 is inserted through a closable opening into a provided secondary packaging 3 with the assistance of a handling device 20.

In the present embodiment, the shown packaging module 1 is equipped with four corresponding handling devices 20, so that four outer packagings 6 can each be filled with articles 4 in parallel and synchronously.

An assembly of a number of articles 4 to be arranged within an outer packaging 6 is removed from the transport device 9 by a manipulation device 34, for example by a suitable gripping device with bottle grippers, gripping tulips or the like. If necessary, a suitably designed gripper head can be provided to remove the corresponding number of articles 4 from the transport device 9 for simultaneous insertion into four outer packagings 6.

At the same time, or at least in close temporal relation, four outer packagings 6 are removed from the magazine 8 and made available for filling. The outer packagings 6 can be provided in the magazine 8, for example, in a folded form in a space-saving manner. In this case, they must first be unfolded into the correct shape by suitable folding devices (not shown).

Each of the unfolded outer packagings has at least one folding flap 15 on at least one lateral edge of its opening, which at least one folding flap 15 can be placed over the opening of the outer packaging 6 by folding in order to at least partially close the opening.

Such closing elements and closing mechanisms are known from and are common in numerous packaging variants, such as cardboard packaging of all kinds.

However, since these lateral folding flaps 15 or cardboard flaps can often assume undefined positions and, in particular, are free to move, it may be useful to guide or hold them in place during the insertion of the articles 4 into the outer packaging 6 and then to grasp and fold them over using suitable tools in order to close the opening in this way.

On each of the outer packagings 6 provided within the packaging module 1 *a* is positioned at their closable opening, which handling device 20 is in a first working state AZ1 (FIG. 2), which handling device 20 guides and/or directs the at least one article 4 during insertion into the opening of the provided outer packaging 6 and which handling device 20 specifies a target position of the at least one article 4 within the outer packaging 6.

After the articles 4 have been inserted into the outer packagings 6, their openings are at least partially closed under the contribution or interaction of the handling devices 20. The handling devices 20 thus act on the one hand as a positioning aid, which ensure that articles 4 can be inserted into their intended target positions within the outer packagings 6 without any obstruction. The positioning aid can be formed, for example, by a type of insertion frame 21.

At least during insertion of the articles 4 into the outer packaging 6, the insertion frame 21 can be at least be partially placed on or brought into exact alignment with the peripheral edge of the opening of the outer packaging 6. For this reason, it is absolutely sensible that such an insertion frame 21 is dimensioned and shaped to correspond to the size and contour of the edge of the opening of the outer packaging 6 so that it can optimally fulfill its task and reliably prevent incorrect insertion and/or misplacement into the outer packaging 6.

It may be provided, for example, that the insertion frame 21 comprises a compartment (not shown) corresponding to the number and grouping of articles 4. By the support of such a compartment, the articles 4 can be advantageously moved or guided therethrough during insertion into the outer packaging 6. Thus, it can be achieved that the compartment defines the target positions of the articles 4 within the outer packaging 6. The at least one article 4 can thus be seized by a suitable manipulation device 34 and guided through the insertion frame 21 and inserted into the outer packaging 6.

In this context, it is preferably provided that the manipulation device 34 is brought in particular into exact alignment with the insertion frame 21 and is moved using the insertion frame 21 as a reference. Furthermore, it is preferably provided that the insertion frame 21 is pulled out or moved out of the outer packaging 6 again before the outer packaging 6 is closed.

On the other hand, in addition to their positioning support, the handling devices 20 perform a dual function that, after the insertion of the articles 4, they act on the outer packagings 6 in such a way that the opening of the outer packagings 6 are closed or at least partially closed. The insertion of the articles 4 and the closing of the outer packagings 6 take place here, in particular, at a common location within the packaging module 1.

According to one embodiment, it may be provided that the outer packaging 6 is statically arranged within the packaging module 1 when the outer packaging 6 is filled with articles 4 and closed.

When a common location is mentioned, however, it does not necessarily have to refer to a static process; it can also be envisaged that the outer packagings 6 are moved continuously within the packaging module in the transport direction TR. In this case, a synchronous movement of the articles 4 during insertion and the handling device 20 associated with the outer packaging 6 is carried out along with the outer packagings 6 in the transport direction TR, which is also referred to as up-synchronization.

In particular, a manipulation device 34 responsible for seizing, handling and inserting the articles 4 can be moved synchronously with the moving outer packaging 6 in the same direction. In this case, the conveying device 12, on which conveying device 12 the outer packagings 6 are arranged and moved, the handling device 20 acting as a positioning aid, and the manipulation device or gripping device 34 together with the articles 4 held thereon all move at the same movement speed in the same direction of movement TR, which in turn satisfies the requirement of the reference location being stationary during insertion and closing.

For the closing, the handling device 20 comprises a closing tool 22, which is in an open position 22*o* in the first working state AZ1. By transferring the closing tool 22 into a closed position 22*g*, the handling device 20 is transferred into a second working state AZ2 (FIG. 3), whereby the protruding folding flap 15 of the outer packaging 6 is folded over in such a way that it now closes the opening of the outer packaging 6.

The folding flap 15 is not visible in the top view of FIGS. 1 and 2, because it is located in alignment with the vertical side walls of the outer packaging 6. In FIG. 3, the folded-over folding flap 15 is indicated, in particular, by a hatching. For example, it is provided that the closing tools 22 are, in particular, equipped with movable and controllable closing elements 23, which closing elements 23 cooperate with sections of the outer packaging 6 in such a way that the closing elements 23 can at least partially close the opening of the outer packaging 6 after insertion of the articles 4. The closing elements 23 are formed, for example, by pusher elements or the like, which can be advanced towards each other.

Since the two core functions of inserting the articles and closing the outer packaging 6, which core functions are performed with the handling device 20, are temporally and spatially related, but by their nature are not performed simultaneously, it may be useful to first terminate the function of the positioning support before starting to close the respective outer packaging 6.

Figure 4:
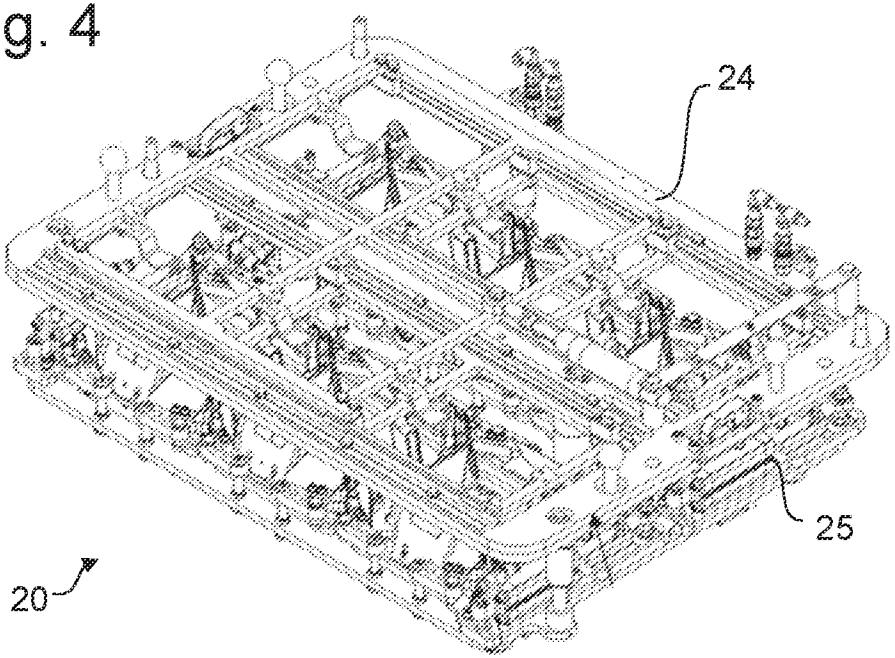
FIG. 4 shows an embodiment of a handling device of the packaging module in perspective view.
Figure 5:
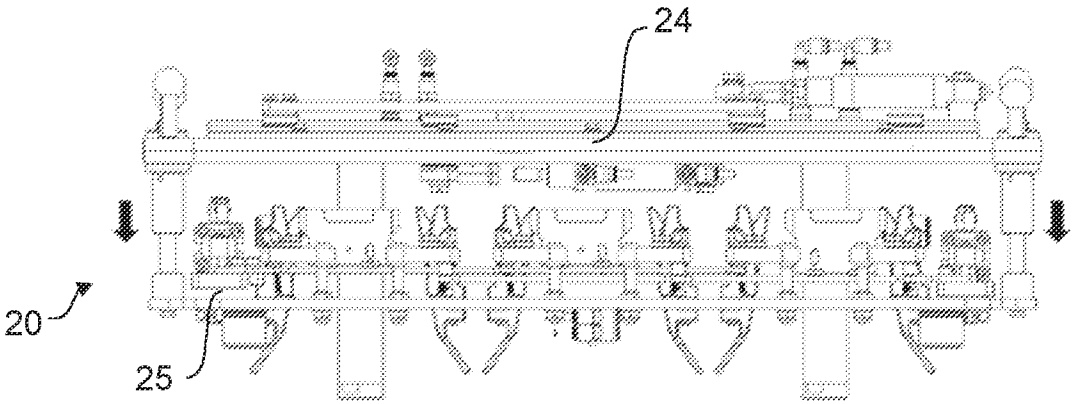
FIG. 5 shows a side view of the embodiment of the handling device shown in FIG. 4.

FIG. 4 shows an embodiment of a handling device 20 of the packaging module 1 in a perspective view. FIG. 5 shows the embodiment of the handling device 20 shown in FIG. 4 in a schematic side view.

The handling device 20 comprises an upper part 24 and a lower part 25, which each have different functions. In addition, the upper part 24 and the lower part 25 are preferably designed to be vertically movable independently of each other. The exact positioning of the upper part 24 and the lower part 25 relative to each other is ensured by suitable interlocking first and second guide 31, 32, which are located on the upper part 24 and on the lower part 25.

In particular, the handling device 20 shown here is equipped for the simultaneous processing of six outer packagings.

First, the lower part 25 is placed on the outer packagings and the articles are inserted into the outer packagings at the same time. The lower part 25 thus acts as a positioning aid and serves to center the outer packagings, thereby enabling the targeted insertion of the articles.

By the lower part 25 also the upper cardboard flaps of the outer packagings (not shown) are partially folded in or pre-folded in a lower area at the corners. The articles are seized here by a manipulation device 34 and the lower part 25 serves as an insertion frame, through which insertion frame the articles are guided.

The manipulation device 34 is formed, in particular, by a gripper head with bottle grippers or the like. The individual grippers can be designed as so-called gripping tulips, which gripping tulips are activated with sufficiently strong negative pressure and which gripping tulips are designed to seize, especially grip, individual bottles or containers in their neck area.

By arranging several such gripping tulips within a gripper head, larger groups of regularly arranged bottles or containers can be gripped and moved at the same time, for example, in order to remove them from a conveying belt 10 and to insert them into the outer packaging 6, which outer packaging 6 is formed, for example, by a folding carton.

Subsequently, the upper part 24 of the handling device 20 moves down and further folds the lower part of the upper folding flaps 15. In particular, the upper part of the upper carton flaps is completely folded over with the aid of closing tools 22 located on the upper part 24 in order to close the lid area of the outer packagings.

Figure 6:
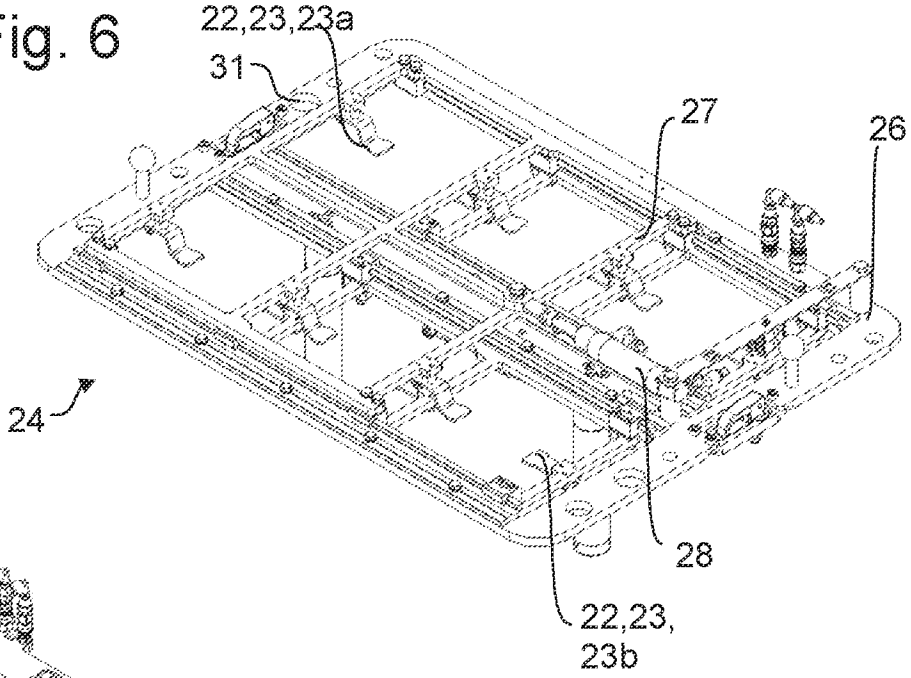
FIG. 6 shows the upper part of the handling device of the packaging module in perspective view.
Figure 7:
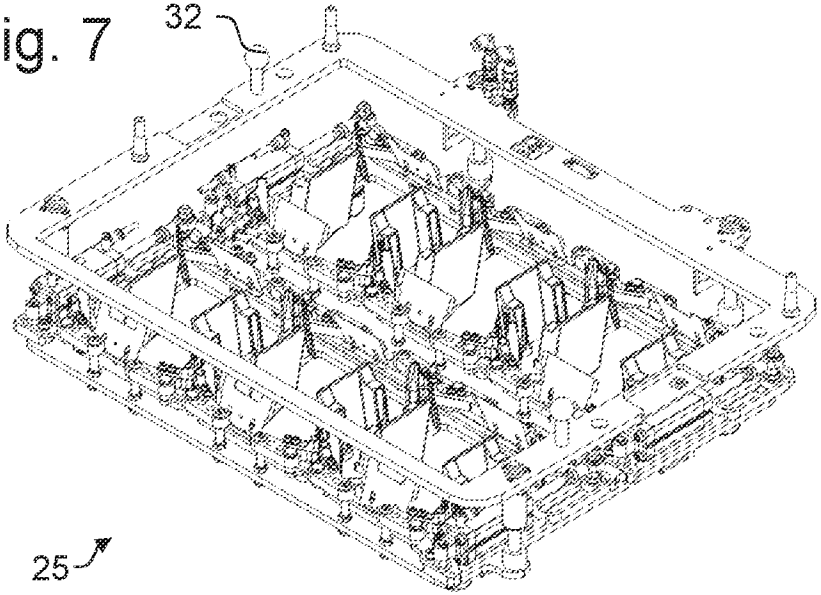
FIG. 7 shows the lower part of the handling device of the packaging module in perspective view.
Figure 9:
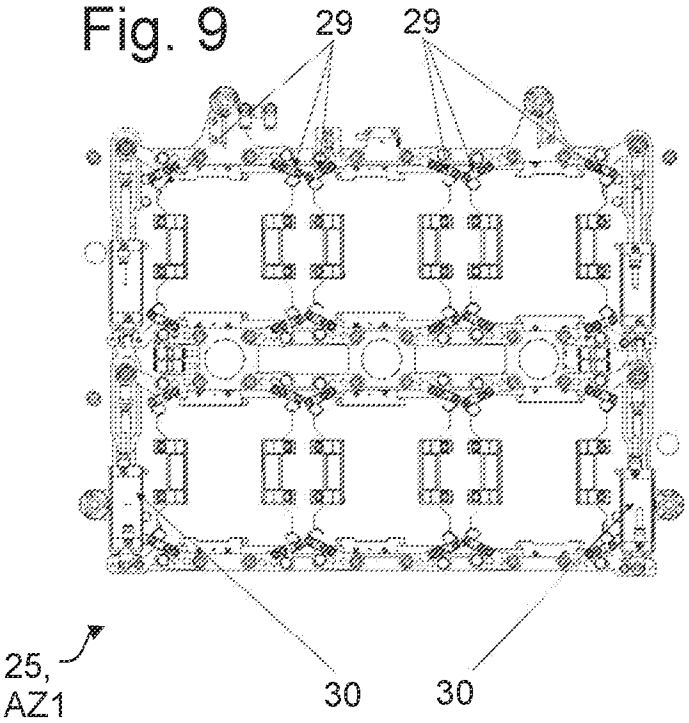
FIG. 9 shows a top view of the lower part of the handling device in a first working state.
Figure 8:
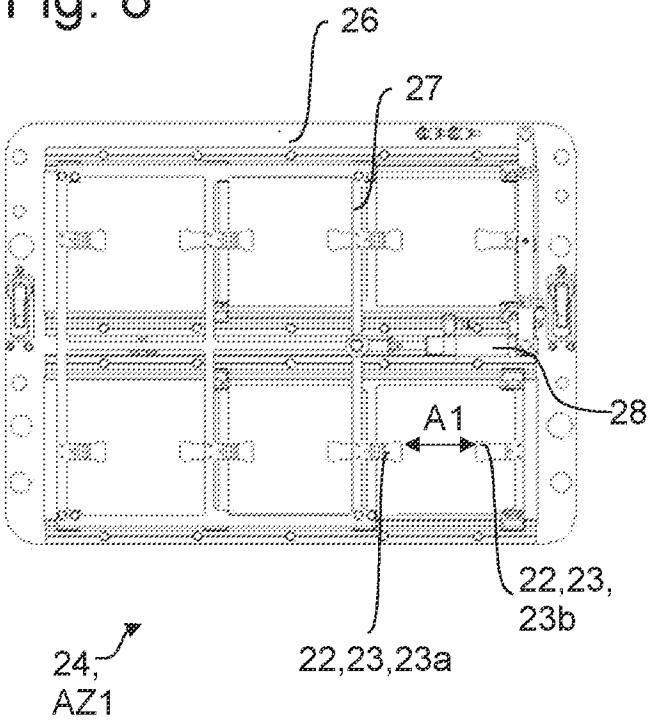
FIG. 8 shows a top view of the upper part of the handling device in a first working state.
Figure 11:
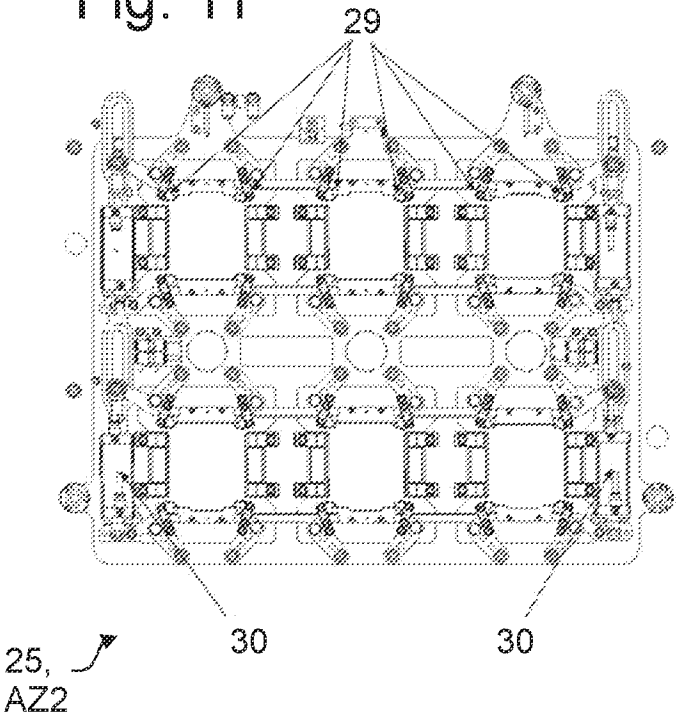
FIG. 11 shows a top view of the lower part of the handling device in a second working state.
Figure 10:
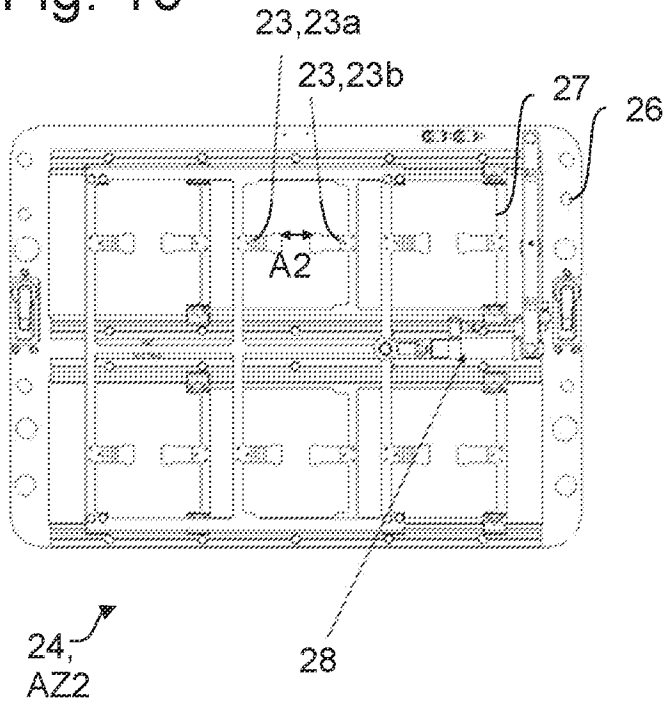
FIG. 10 shows a top view of the upper part of the handling device in a second working state.

FIGS. 6, 8 and 10 each show the upper part 24 of the handling device 20. FIGS. 7, 9 and 11 each show the lower part 25 of the handling device 20. Thereby, FIGS. 8 and 9 each show a first working state AZ1, while FIGS. 10 and 11 each show a second working state AZ2.

What is to be understood by the first working state AZ1 and the second working state AZ2 will be explained in more detail below.

The lower part 25 of the handling device 20 is equipped with folding elements 29, which can be moved for partial folding or pre-folding of the lower part of the upper carton flaps via second pneumatic cylinders 30, which can be seen, in particular, when comparing FIGS. 9 and 11.

For each of the outer packagings to be closed, the upper part 24 comprises two respective closing elements 23*a* and 23*b*, which closing elements 23*a* and 23*b* can be advanced towards one another. In particular, it is provided that the upper part 24 comprises a base frame element 26 and a frame element 27, which frame element 27 is designed to be movable relative to the base frame element 26.

In particular, a first pneumatic cylinder 28 is assigned to the movable frame element 27, via which first pneumatic cylinder 28 the base frame element 26 and the movably designed frame element 27 are operatively connected to one another. One of the closing elements 23*a* of each pair of closing elements 23*a*, 23*b* is arranged on the movable frame element 27.

In the illustrated exemplary embodiment, in the first working state AZ1 the first pneumatic cylinder 28 is in an extended state and in the second working state AZ2 it is in a retracted state. The mean first distance A1 between a pair of closing elements 23*a*, 23*b* within the first working state AZ1 is thereby greater than the mean second distance A2 between a pair of closing elements 23*a*, 23*b* within the second working state AZ2.

Both the folding elements 29 and the closing elements 23*a*, 23*b* are designed to be at least partially movable and correspondingly controllable in order to at least partially close the outer packagings at their openings after at least one article has been inserted thereinto in each instance.

According to a preferred embodiment of the packaging module 1 according to the invention, the folding elements 29 as well as the closing elements 23*a*, 23*b* can be equipped with or comprise controllable levers and/or gripping elements, which can cooperate with folding flaps of the outer packaging and fold the latter over the closable opening. The controllable levers can preferably be rotated or pivoted about pivot axes, which pivot axes are anchored to the handling device 20, to cooperate in such a way with the sections of the outer packaging to be folded and thereby close the outer packaging with the articles contained therein.

The folding elements 29 and/or the closing elements 23*a*, 23*b* can, for example, comprise lever mechanisms, which can be controlled and actuated by an electric motor, pneumatically or hydraulically. Thereby, pivoting levers controlled in this way can ensure an exact closing movement of the folding flaps of the folding carton forming the outer packaging, which folding flaps previously did not cover the opening. If applicable, additional gripping clamps or gripping tongs or the like can be arranged on these pivoting levers, which gripping clamps or gripping tongs can be suitable for gripping the folding flaps or carton flaps and grasping them during their pivoting.

However, since the positions and movement ranges of the folding flaps are normally known and limited, it should usually be sufficient in practice to design the closing elements by pivoting levers with a clearly defined movement profile, since in this way more complex actuating movements and control mechanisms can be dispensed with without this having to be associated with disadvantages in the task performance of the handling device.

Optionally, the folding elements 29 and/or the closing elements 23*a*, 23*b* can be equipped with additional functions so that, for example, further closures can be inserted, actuated or activated with them. For example, it may be useful to apply adhesive with the closing elements 23*a*, 23*b* or with additional actuators or applicators in order to adhere the folding flap to an underlying section of the outer packaging, or in order to clamp the folding flap to a section of the outer packaging.

It can thus be stated as a feature of the method, which is equally applicable to all variants explained here and which is recognizable across the board, that in the packaging method according to the invention both a temporal and a positional component of the insertion of the at least one article 4 into the outer packaging 6 and the closing of the outer packaging 6 are closely related to one another or are coupled with one another, because the insertion of the article 4 into the outer packaging 6 and the subsequent closing of the outer packaging 6 take place at the same position, even though this takes place sequentially in time one after the other.

During the insertion of the at least one article 4 into the outer packaging 6, its opening must still be accessible. During the closing of the opening of the outer packaging 6, the at least one article 4 must already be at its destination within the outer packaging 6. Thus, both operations take place at the same location, but subsequently follow each other in terms of time.

The embodiments, examples and variations of the preceding paragraphs, the claims or the following description and the figures, including their various views or respective individual features, may be used independently or in any combination. Features described in connection with one embodiment are applicable to all embodiments unless the features are incompatible.

Although the figures generally refer to "schematic" representations and views, this does not mean that the figure representations and their description are of secondary importance with respect to the disclosure of the invention. The person skilled in the art is quite capable of obtaining enough information from the schematically and abstractly drawn representations to facilitate his understanding of the invention without being impaired in any way in his understanding, for example, by the drawn and possibly not exactly to scale proportions of the articles and/or parts of the device or other drawn elements. The figures thus enable the skilled person as a reader to derive a better understanding of the idea of the invention formulated in a more general and/or abstract manner in the claims as well as in the general part of the description on the basis of the more concretely explained implementations of the process according to the invention and the more concretely explained mode of operation of the device according to the invention.

The invention has been described with reference to preferred embodiments. To the expert it is also conceivable, however, to make changes and modifications without leaving the scope of protection of the appended claims.

LIST OF REFERENCE SIGNS

1 packaging module
2 primary packaging
3 secondary packaging
4 article
5 beverage container
6 outer packaging
7 folding carton
8 magazine
9 transport device
10 conveying belt
11 lane plate
12 conveying device
15 folding flab
20 handling device
21 insertion frame
22 closing tool
22*o* closing tool in open position
22*g* closing tool in closed position
23 closing element
24 upper part
25 lower part
26 base frame element
27 frame element, movable frame element
28 first pneumatic cylinder
29 folding elements
30 second pneumatic cylinder
31 first guide
32 second guide
34 manipulation device or gripping device
A1 first distance
A2 second distance
AZ1 first working state
AZ2 second working state
TR transport direction
ZF feeding direction

The invention claimed is:

1. A packaging method comprising:

grasping at least one primary packaging (2) with a manipulation device;

inserting the at least one primary packaging (2), through a closable opening of a secondary packaging (3), into the secondary packaging (3) after a handling device (20) has been positioned at the closable opening of the secondary packaging (3), wherein the handling device (20) guides the at least one primary packaging (2) during insertion into the secondary packaging (3) and predetermines a target position of the at least one primary packaging (2) within the secondary packaging (3) and wherein the at least one primary packaging (2) is inserted into the secondary packaging (3) exactly vertically or with minimal deviation from a vertical direction of movement; and after the insertion of the at least one primary packaging (2) into the secondary packaging (3), at least partially closing the closable opening of the secondary packaging (3) under cooperation or action of the handling device (20).

2. The packaging method of claim 1, wherein the inserting step and the at least partially closing step take place at the same location.

3. The packaging method of claim 1, wherein the inserting step and the at least partially closing step occur sequentially at the same location.

4. The packaging method of claim 1, wherein the handling device (20) is equipped with movable and controllable closing elements (23, 29), which at least partially close the secondary packaging (3) at its closable opening.

5. The packaging method of claim 1, wherein the secondary packaging (3) has at least one folding flap (15) on at least one lateral edge of its opening, wherein the at least one folding flap (15) can at least partially close the closable opening.

6. The packaging method of claim 4, wherein the movable and controllable closing elements (23, 29) of the handling device (20) apply or affix further closures to the secondary packaging (3).

7. The packaging method of claim 1, wherein the handling device (20) comprises an insertion frame (21), wherein the insertion frame (21) is placed on or brought into alignment with a peripheral edge of the closable opening at least during the inserting step.

8. The packaging method of claim 7, wherein the insertion frame (21) comprises a compartment corresponding to a number and grouping of the at least one primary packaging, through which compartment the at least one primary packaging is moved or passed during the inserting step.

9. The packaging method of claim 7, wherein the at least one primary packaging is grasped by the manipulation device, passed through the insertion frame, and inserted into the secondary packaging (3).

10. The packaging method of claim 1, wherein the handling device (20), after the insertion of the at least one primary packaging (2) into the secondary packaging (3), also closes or at least partially closes the closable opening of the secondary packaging (3).

11. The packaging method of claim 1, wherein the manipulation device has a gripper head with at least one bottle gripper or gripping tulip.

12. The packaging method of claim 11, wherein the at least one bottle gripper or gripping tulip comprises a plurality of bottle grippers or gripping tulips.

13. A packaging method comprising:

grasping at least one primary packaging (2) with a manipulation device; and inserting the at least one primary packaging (2), through a closable opening of a secondary packaging (3), into the secondary packaging (3) after a handling device (20) has been positioned at the closable opening of the secondary packaging (3), wherein the handling device (20) guides the at least one primary packaging (2) during insertion into the secondary packaging (3) and predetermines a target position of the at least one primary packaging (2) within the secondary packaging (3), wherein the at least one primary packaging (2) is inserted into the secondary packaging (3) exactly vertically or with minimal deviation from a vertical direction of movement, and wherein the handling device (20) is equipped with movable and controllable closing elements (23, 29), and after the insertion of the at least one primary packaging (2) into the secondary packaging (3), the handling device closes or at least partially closes the closable opening of the secondary packaging (3).

14. The packaging method of claim 13, wherein the manipulation device has a gripper head with at least one bottle gripper or gripping tulip.

15. The packaging method of claim 14, wherein the at least one bottle gripper or gripping tulip comprises a plurality of bottle grippers or gripping tulips.

16. A packaging method comprising:

grasping at least one primary packaging (2) with a manipulation device having a gripper head with at least one bottle gripper or gripping tulip;

inserting the at least one primary packaging (2), through a closable opening of a secondary packaging (3), into the secondary packaging (3) after a handling device (20) has been positioned at the closable opening of the secondary packaging (3), wherein the handling device (20) guides the at least one primary packaging (2) during insertion into the secondary packaging (3) and predetermines a target position of the at least one primary packaging (2) within the secondary packaging (3) and wherein the at least one primary packaging (2) is inserted into the secondary packaging (3) exactly vertically or with minimal deviation from a vertical direction of movement; and after the insertion of the at least one primary packaging (2) into the secondary packaging (3), at least partially closing the closable opening of the secondary packaging (3) under cooperation or action of the handling device (20).

17. The packaging method of claim 16, wherein the at least one bottle gripper or gripping tulip comprises a plurality of bottle grippers or gripping tulips.

18. The packaging method of claim 16, wherein the handling device (20), after the insertion of the at least one primary packaging (2) into the secondary packaging (3), also closes or at least partially closes the closable opening of the secondary packaging (3).

* * * * *